United States Patent [19]

Narramore

[11] Patent Number: 4,981,302

[45] Date of Patent: Jan. 1, 1991

[54] ROPING PRACTICE DEVICE

[76] Inventor: L. B. Narramore, 1200 Cordova, Grants, N. Mex. 87020

[21] Appl. No.: 494,776

[22] Filed: Mar. 16, 1990

[51] Int. Cl.[5] ..... A63B 67/00; F41J 9/02

[52] U.S. Cl. ..... 273/339; 273/370

[58] Field of Search ..... 273/336, 338, 339, 359, 273/369, 370

[56] References Cited

U.S. PATENT DOCUMENTS 3,160,983 12/1964 Smith et al. ..... 273/359 X
3,303,821 2/1967 Harris ..... 273/359 X
3,776,553 12/1973 Kelton ..... 273/339
3,802,706 4/1974 Hamm ..... 273/339

*Primary Examiner*—William H. Grieb
*Attorney, Agent, or Firm*—Dean P. Edmundson

[57] ABSTRACT

A roping practice device is described which includes a wheeled body member simulating an animal to be roped. An electric motor powers the body member selectively forwardly and rearwardly. Rear extension members are oscillated between upper and lower positions to simulate rear legs of the animal while running. The device is useful for practicing the art of roping.

10 Claims, 2 Drawing Sheets

ROPING PRACTICE DEVICE

FIELD OF THE INVENTION

This invention relates to practice devices. More particularly, this invention relates to devices for practicing the art of roping. Even more particularly, this invention relates to practice devices including a movable or propelled target.

BACKGROUND OF THE INVENTION

The art or sport of roping (i.e., catching a moving animal with a length of rope) is becoming ever more popular. The athletes who engage in such activities are also becoming much more competitive.

To develop, improve, and maintain roping skills, ropers engage in regular practice. Typically this involves use of a horse, a number of calves or steers, and a rather large pen or arena. Various helpers or assistants may also be required to assist in preparing the arena and the cattle for the practice. Consequently, the time and expense involved in roping practice using live animals can be quite considerable.

Other complicating factors involved with roping of live animals include the travel to the practice arena, the weather on the selected day, and the lack of lights at the arena. These factors can inhibit or limit the practice time.

Although various mechanical devices have been previously proposed for use in practicing the art of roping, such devices have various limitations and disadvantages. For example, some of such devices are intended only for use outdoors or in an arena large enough to accommodate a towing machine (e.g., a truck or tractor). Some of such devices are very small and are intended only for use as toys. Such devices are either stationary or are movable only by pulling them manually. Another device has been proposed which is stationary but includes an electric motor to pivot the rear legs of a simulated animal back and forth for roping practice.

There has not heretofore been provided a roping practice device having the advantages provided by the present invention.

SUMMARY OF THE PRESENT INVENTION

In accordance with the present invention there is provided a roping practice device comprising:

(a) a wheeled body member simulating an animal to be roped; the body member including at least one rearwardly extending extension member simulating a rear leg of the animal;

(b) an electric motor carried by the body member; the motor being adapted to power the body member;

(c) oscillating means carried by the body member and being adapted to oscillate the extension member between upper and lower positions; and (d) control means for controlling movement of the body member.

The practice device can be conveniently used indoors or outdoors, although its primary utility is normally indoors. The electric motor can be adapted to power the wheeled body forwardly or rearwardly, as desired. It can also be stopped and started at will from a remote position.

The rear extension member(s) simulates the rear legs of an animal while running. Thus, the practice device is especially useful for practicing the art of roping the "heels" or rear legs of the simulated animal.

With the use of the practice device of this invention it is not necessary to use live animals or to use an arena and other associated equipment. The action of the moving practice device, and the oscillating rear extension members, closely simulates the real life action involved in roping the rear legs of a live animal. Thus, the practice device is helpful for a person to practice the art of roping. Preferably the body includes a head member having horns. The enables the person roping to also practice roping the head or horns, if desired.

The practice device can be made in any desired size. Thus, smaller devices are especially useful for use in a living room, bedroom, or den, for example. Larger sizes can be made for use in larger rooms, for example, or even for use outdoors, if desired. The device can be made to move at a desired speed.

Other disadvantages and features of the practice device of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
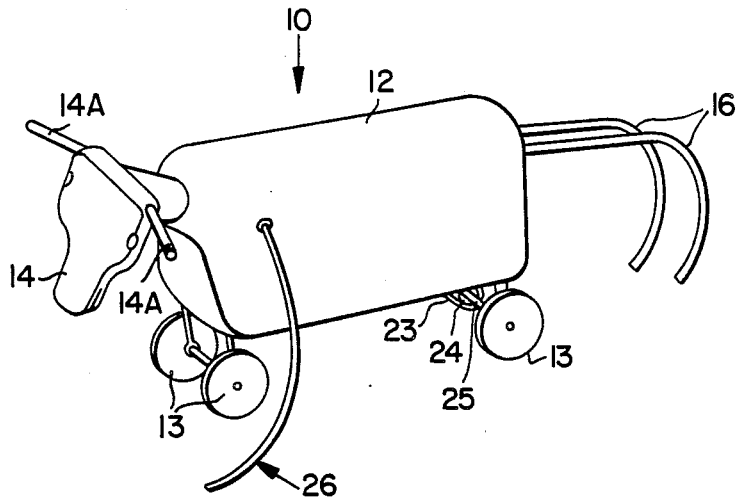
FIG. 1 is a perspective view of a preferred embodiment of roping practice device of the invention.

In the drawings there is illustrated one embodiment of roping practice device 10 comprising a body member 12 supported by wheels 13. Preferably the body includes a head member 14 having horns 14A.

Projecting rearwardly there are preferably two extension members 16 simulating rear legs of an animal. As illustrated, the rear extension or leg members are curved or otherwise include an arc-shape.

An electric motor 20 is carried or secured inside the body member for powering the body member selectively forwardly or rearwardly, as desired. The motor is operatively connected by means of pulley 22, belt 23, and pulley 24 to axle 25 to which wheels 13 are mounted.

The motor 20 is also operatively connected to a source of electrical energy by means of power cord 26. A transformer 28 is operatively connected to reduce the voltage from 110 A.C. volts to 12 volts, for example.

Control means 30 is also operatively connected to the power cord for remotely controlling operation of the electrical motor 20. The control means includes an on-off switch 30A for starting and stopping flow of current to the motor 20. Switch 30B is a two position switch which controls the direction of travel of the body member (i.e., either forwardly or rearwardly) by reversing the direction of rotation of the motor.

Figure 3:
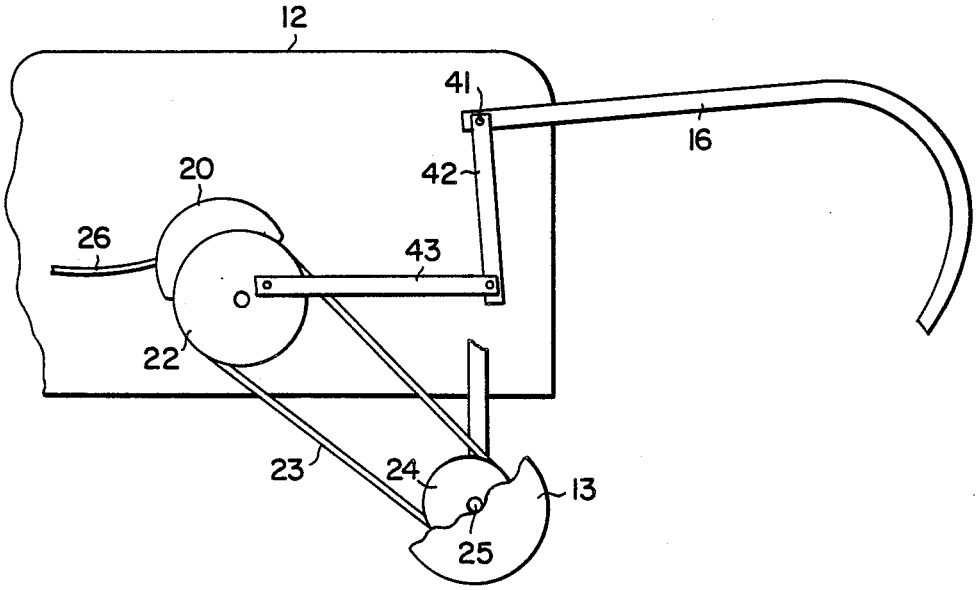
FIG. 3 is a side elevational, partially cut-away, view illustrating the power means and oscillating means used in the embodiment of FIG. 1.
Figure 2:
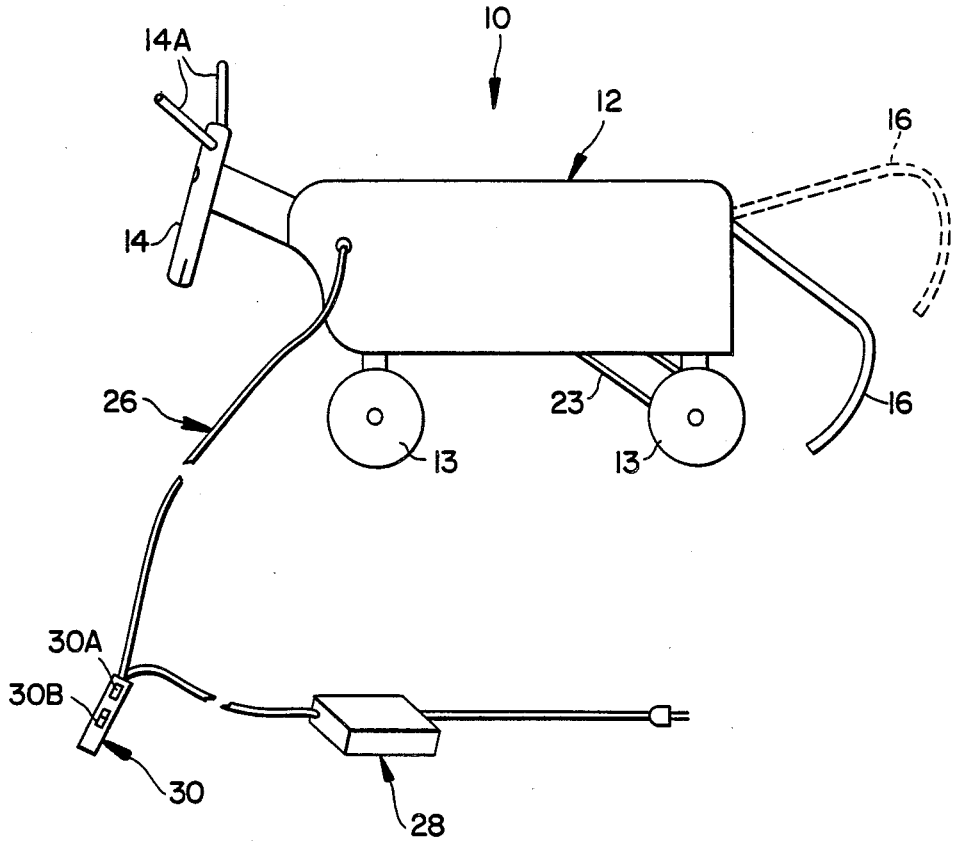
FIG. 2 is a side elevational view of the embodiment shown in FIG. 1.

Preferably the rear extension members 16 are secured to an axle 41 at or within the rear portion of the body 12. The axle is free to pivot or rotate relative to the body 12. An arm 42 extends downwardly from the axle and is secured at its upper end to the axle, as illustrated in FIG. 3. The lower end of arm 42 is attached to one end of arm 43. The other end of arm 43 is attached to pulley 22 in a manner such that arm 43 reciprocates back and forth in response to rotation of pulley 22. This causes arm 42 to pivot or rotate axle 41 in a back and forth manner, which in turn causes the rear extension members 16 to oscillate between the upper and lower positions (shown in FIG. 2 with solid and dotted lines).

The up and down motion of the rear extension members as the animal is propelled simulates the action of the rear legs of an animal while running. Accordingly, more skill is required to rope the extension members in motion than would be required if such members were stationary or fixed in position. Of course, it is also possible to rope the head or horns of the simulated animal while it is being propelled, if desired. Also, one person may rope the head and another person may rope the rear "legs" of the simulated animal.

Other variants are possible without departing from the scope of this invention. For example, the body member may be carried on or guided by a track, if desired. This is considered to be an equivalent to the embodiment disclosed in the drawings. Also, if desired, the electric motor could be powered by a battery and controlled by means of radio waves, although this would increase the cost of the unit. It is also possible to connect the head of the body member in such a way that the head will bob up and down as the body member is propelled. For example, the head could be carried on an axle similar to that used for the rear extension members, and an arm may be operatively connected to such an axle and reciprocated by a pulley driven by the electric motor. It is also possible to include means for changing the speed at which the device is propelled, if desired. Other variants are also possible.

What is claimed is:

1. A roping practice device comprising:

(a) a wheeled body member simulating an animal to be roped; said body member including at least one rearwardly extending extension member simulating a rear leg of said animal;

(b) an electric motor carried by said body member; said motor being adapted to power said body member forwardly and rearwardly;

(c) oscillating means carried by said body member and being adapted to oscillate said extension member between upper and lower positions; and (d) control means electrically connected to said electric motor for controlling movement of said body member.

2. A device in accordance with claim 1, wherein there are two said extension member simulating the rear legs of said animal.

3. A device in accordance with claim 1, wherein said control means includes first actuation means for controlling starting and stopping of said electric motor and second actuation means for controlling the direction of travel of said body member.

4. A device in accordance with claim 1, wherein said body member further includes a head member.

5. A device in accordance with claim 1, wherein said extension member includes a leading end which is pivotally attached to said body member; and wherein said electric motor is adapted to drive said oscillating means.

6. A device in accordance with claim 5, further comprising an axle secured to said leading end of said extension member, and further comprising an arm secured to said axle; wherein said arm is operatively connected to said oscillating means.

7. A roping practice device comprising:

(a) a wheeled body member simulating an animal to be roped; said body member including two rearwardly extending extension members simulating rear legs of said animal; wherein said body member further includes a head member;

(b) an electric motor carried by said body member; said motor being adapted to power said body member forwardly and rearwardly;

(c) oscillating means carried by said body member and being adapted to oscillate said extension members between upper and lower positions; and (d) control means electrically connected to said electric motor for controlling movement of said body member.

8. A device in accordance with claim 7 wherein said control means includes first actuation means for controlling starting and stopping of said electric motor and second actuation means for controlling the direction of travel of said body member.

9. A device in accordance with claim 7, wherein said extension member includes a leading end which is pivotally attached to said body member; and wherein said electric motor is adapted to drive said oscillating means.

10. A device in accordance with claim 9, further comprising an axle secured to said leading end of said extension member, and further comprising an arm secured to said axle; wherein said arm is operatively connected to said oscillating means.

* * * * *